US010248144B2

(12) United States Patent
Wang

(10) Patent No.: US 10,248,144 B2
(45) Date of Patent: Apr. 2, 2019

(54) LINEAR REGULATOR DEVICE WITH RELATIVELY LOW STATIC POWER CONSUMPTION

(71) Applicant: SHENZHEN GOODIX TECHNOLOGY CO., LTD., Shenzhen, Guangdong (CN)

(72) Inventor: Chengzuo Wang, Guangdong (CN)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/790,976

(22) Filed: Oct. 23, 2017

(65) Prior Publication Data

US 2018/0059699 A1 Mar. 1, 2018

Related U.S. Application Data

(63) Continuation of application No. PCT/CN2016/095428, filed on Aug. 16, 2016.

(51) Int. Cl.
*G05F 1/575* (2006.01)
*G05F 1/46* (2006.01)

(52) U.S. Cl.
CPC ..... *G05F 1/575* (2013.01); *G05F 1/468* (2013.01)

(58) Field of Classification Search
CPC ..... G05F 1/465; G05F 1/575
See application file for complete search history.

(56) References Cited

U.S. PATENT DOCUMENTS

| | | | | |
|---|---|---|---|---|
| 5,047,706 | A * | 9/1991 | Ishibashi | G05F 1/463 323/313 |
| 5,793,254 | A * | 8/1998 | O'Connor | H03G 1/007 330/282 |
| 7,446,514 | B1 * | 11/2008 | Li | G05F 1/575 323/280 |
| 9,519,304 | B1 * | 12/2016 | Far | G05F 3/262 |
| 9,651,965 | B2 * | 5/2017 | Cui | G05F 1/575 |
| 9,753,471 | B2 * | 9/2017 | Chellappa | G05F 1/575 |
| 9,904,305 | B2 * | 2/2018 | Brown | G05F 1/575 |
| 9,921,600 | B1 * | 3/2018 | Far | G05F 3/262 |
| 2002/0130646 | A1 * | 9/2002 | Zadeh | G05F 1/575 323/275 |

(Continued)

FOREIGN PATENT DOCUMENTS

| | | | |
|---|---|---|---|
| CN | 105005351 | A | 10/2015 |
| CN | 105786081 | A | 7/2016 |

*Primary Examiner* — Yusef A Ahmed
(74) *Attorney, Agent, or Firm* — Heslin Rothenberg Farley & Mesiti P.C.

(57) ABSTRACT

A linear regulator includes: a current bias module, a voltage bias module having positive temperature characteristics, and a flip voltage follower. An input end of the current bias module receives an input voltage of the linear regulator, and an output end of the current bias module outputs a bias current. A first input end and a second input end of the voltage bias module receive the input voltage and the bias current, respectively, and an output end of the voltage bias module outputs a bias voltage. A first input end and a second input end of the flip voltage follower receive the input voltage and the bias voltage, respectively, and an output end of the flip voltage follower outputs an output voltage of the linear regulator.

10 Claims, 4 Drawing Sheets

(56) References Cited

U.S. PATENT DOCUMENTS

| | | | | |
|---|---|---|---|---|
| 2002/0171403 | A1* | 11/2002 | Lopata | H03F 3/45183 323/280 |
| 2002/0175761 | A1 | 11/2002 | Bach et al. | |
| 2006/0113972 | A1* | 6/2006 | Mihara | G05F 1/575 323/273 |
| 2006/0244532 | A1* | 11/2006 | Trifonov | H03F 3/45219 330/258 |
| 2008/0218137 | A1* | 9/2008 | Okuyama | G05F 1/575 323/273 |
| 2008/0224679 | A1* | 9/2008 | Sahni | G05F 1/575 323/284 |
| 2008/0224761 | A1* | 9/2008 | Deng | G05F 3/30 327/539 |
| 2009/0315526 | A1* | 12/2009 | Do Couto | G05F 1/575 323/275 |
| 2011/0121809 | A1* | 5/2011 | Camacho Galeano | G05F 3/262 323/313 |
| 2011/0133707 | A1* | 6/2011 | Giroud | G05F 3/30 323/265 |
| 2013/0241649 | A1* | 9/2013 | Fort | G05F 1/575 330/253 |
| 2014/0117950 | A1* | 5/2014 | Ng | G05F 1/575 323/265 |
| 2015/0077188 | A1 | 3/2015 | Zhan | |
| 2016/0085250 | A1* | 3/2016 | Luo | G05F 1/468 323/281 |
| 2016/0091906 | A1* | 3/2016 | Chellappa | G05F 1/575 323/313 |
| 2016/0291620 | A1* | 10/2016 | Zhou | G05F 1/575 |
| 2017/0090493 | A1* | 3/2017 | Cui | G05F 1/575 |
| 2017/0153659 | A1* | 6/2017 | Quelen | G05F 3/242 |
| 2017/0212539 | A1* | 7/2017 | Zhang | G05F 1/56 |
| 2018/0067512 | A1* | 3/2018 | Lin | H03F 3/217 |

* cited by examiner

LINEAR REGULATOR DEVICE WITH RELATIVELY LOW STATIC POWER CONSUMPTION

CROSS-REFERENCE TO RELATED APPLICATION

The present application is a continuation of international application No. PCT/CN2016/095428 filed on Aug. 16, 2016, which is hereby incorporated by reference herein, in its entirety.

TECHNICAL FIELD

The present disclosure relates to the field of electronics, and in particular, to a linear regulator.

BACKGROUND

A linear regulator is also referred to as a series regulator. A linear regulator can be used to convert an unstable input voltage into an adjustable direct output voltage so as to provide a power source to another system. A linear regulator has a simple structure, less static power consumption, and a small output voltage ripple etc. As a result, the linear regulator is generally used for the intra-chip power source management of a chip in a consumer mobile electronic device.

FIG. 1 is a schematic structural diagram of a linear regulator in the related art. The linear regulator includes: a bias module 1, a reference voltage module 2, an error amplifier 3, a power transistor 4, and a sampling resistor network 5.

An input voltage $V_{IN}$ of the linear regulator is input into the bias module 1, the reference voltage module 2, and the power transistor 4, respectively. The bias module 1 provides a current bias and a voltage bias to the reference voltage module 2 and the error amplifier 3 for a normal operation of the reference voltage module 2 and the error amplifier 3. The reference voltage module 2 generates a reference voltage $V_{REF}$ with a low temperature drift for the error amplifier 3. The error amplifier 3 amplifies an error between $V_{REF}$ and a feedback voltage $V_{FB}$ that is obtained by sampling an output voltage $V_O$ by a sampling resistor network 5, so as to regulate a gate voltage of the power transistor 4 according to an error amplification result and to stabilize an output of the output voltage $V_O$.

With fast development of technologies in the Internet of Things, people have higher requirements on mobile consumer electronic devices. When a system of an electronic device is in a sleeping standby state, power consumption of intra-chip power source management of an electronic device chip should be as low as possible, so as to achieve a longer device operation time and a relatively long electronic device standby time. However, a linear regulator in the related art may be difficult to satisfy a requirement that a static current is in the range of hundreds of nanoamperes or even dozens of nanoamperes when the electronic device is in a standby state. In addition, the sampling resistor network 5 in the linear regulator of related art occupies a relatively large chip area, which is disadvantageous to the development of miniaturizing an electronic device.

SUMMARY

One of the objectives of the embodiments of the present disclosure is to provide a linear regulator with relatively low static power consumption and a relatively small area on a chip. Also, due to the fact that a voltage bias module with positive temperature characteristics compensates negative temperature characteristics of a flip voltage follower, an output voltage of the linear regulator can have good temperature characteristics even when the linear regulator does not have a reference voltage module.

To solve the above technical problem, an embodiment the present disclosure provides a linear regulator including a current bias module, a voltage bias module having positive temperature characteristics, and a flip voltage follower.

An input end of the current bias module receives an input voltage of the linear regulator, and an output end of the current bias module outputs a bias current.

A first input end and a second input end of the voltage bias module receive the input voltage and the bias current respectively, and an output end of the voltage bias module outputs a bias voltage.

A first input end and a second input end of the flip voltage follower receive the input voltage and the bias voltage respectively, and an output end of the flip voltage follower outputs an output voltage of the linear regulator.

In the embodiment of the present disclosure, as compared with the existing technologies, the input voltage of the linear regulator is input to the input end of the current bias module. In the first input end of the voltage bias module and the first input end of the flip voltage follower, the current bias module generates the bias current, and the second input end of the voltage bias module receives the bias current. The voltage bias module generates the bias voltage, and the second input end of the flip voltage follower receives the bias voltage. The output voltage of the linear regulator is output by the output end of the flip voltage follower. The flip voltage follower is provided to follow and compensate the output voltage of the linear regulator, so that the output voltage of the linear regulator is relatively stable. In addition, the voltage bias module has the positive temperature characteristics and can mutually compensate with the flip voltage follower, to offset negative temperature characteristics of the flip voltage follower, so that the output voltage of the linear regulator has good temperature characteristics. In this way, the linear regulator has characteristics of relatively low static power consumption and a relatively small chip occupation area. Also, the output voltage of the linear regulator can achieve good temperature characteristics without a need of specifically setting a reference voltage module.

In addition, the current bias module includes a bias current generation circuit and an auxiliary output circuit. An input end of the bias current generation circuit is connected to the input voltage of the linear regulator. An output end of the bias current generation circuit is connected to an input end of the auxiliary output circuit. An output end of the auxiliary output circuit is connected to the second input end of the voltage bias module. The input end of the bias current generation circuit and the output end of the auxiliary output circuit respectively form the input end and the output end of the current bias module. A required bias current (generally, the required bias current is a nanoampere-level bias current) is generated by using the bias current generation circuit, and the bias current of the bias current generation circuit is output to the voltage bias module by using the auxiliary output circuit.

In addition, the auxiliary output circuit includes a current mirror circuit and a field effect transistor, where an input end of the current mirror circuit is connected to the output end of the bias current generation circuit, and an output end of the current mirror circuit is connected to a drain of the field effect transistor; and a source and a gate of the field effect transistor are connected to the input end and the output end of the current bias module respectively. This embodiment provides a specific example of the auxiliary output circuit, that is, the bias current in the bias current generation circuit is copied to the drain of the field effect transistor by using the current mirror circuit, so that the field effect transistor inputs the bias current to the voltage bias module. In addition, by using the auxiliary output circuit including the current mirror circuit, there is a relatively large flexibility in the circuit design of such a bias current generation circuit.

In addition, the auxiliary output circuit includes a field effect transistor, where a drain and a gate of the field effect transistor form the input end and the output end of the auxiliary output circuit respectively. This embodiment provides a specific example of the auxiliary output circuit in respect of feasibility of the present disclosure.

In addition, the voltage bias module includes a series self-cascode MOSFET (SSCM) circuit, which provides a specific implementation manner of the voltage bias module, thereby increasing feasibility of the present disclosure. In addition, in the present disclosure, as the SSCM circuit can work in a sub-threshold region, static power consumption of the linear regulator can be very small.

In addition, the flip voltage follower includes a folded cascode amplifier and a power transistor; a first input end of the folded cascode amplifier and a source of the power transistor form the first input end of the flip voltage follower; a second input end of the folded cascode amplifier forms the second input end of the flip voltage follower; a first output end of the folded cascode amplifier is connected to a gate of the power transistor; and a second output end of the folded cascode amplifier forms the output end of the flip voltage follower and is connected to a drain of the power transistor. As the folded cascode amplifier samples an output voltage of the linear regulator and amplifies an error of the output voltage, and a result of the error method is output to the gate of the power transistor, a gate voltage of the power transistor can be regulated to stabilize the output voltage of the linear regulator.

In addition, the flip voltage follower further includes an output capacitor. The output capacitor is placed between an output end and a ground end of the flip voltage follower. The output capacitor is used to stabilize the linear regulator.

DETAILED DESCRIPTION

To make the objectives, technical solutions, and advantages of the present disclosure clearer, the following describes the details of various embodiments of the present disclosure with reference to the accompanying drawings. However, a person skilled in the art can understand that in the embodiments of the present disclosure, many technical details are provided to make the readers to better understand this application. However, even if such technical details and various changes and modifications that are based on the following embodiments are not provided, the technical solutions of this application can also be achieved.

Figure 1:
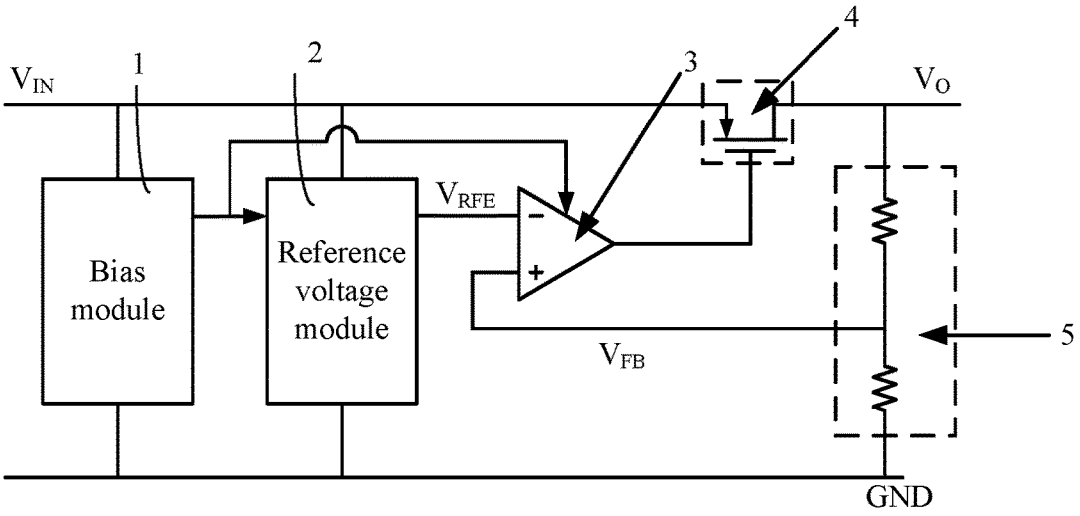
Fig. 1 (Prior Art)
FIG. 1 is a schematic structural diagram of a linear regulator in the related art.
Figure 2:
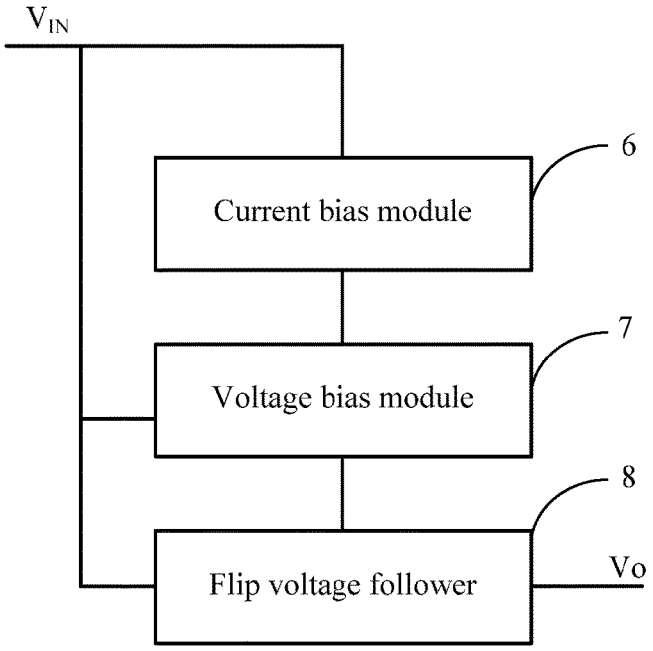
FIG. 2 is a schematic structural diagram of a linear regulator according to a first embodiment of the present disclosure.

A first embodiment of the present disclosure relates to a linear regulator. As shown in FIG. 2, the linear regulator includes a current bias module, a voltage bias module having positive temperature characteristics, and a flip voltage follower. The linear regulator in this embodiment may be applied to mobile terminals having rechargeable cells, such as a mobile phone, a computer, a tablet computer, and a wearable device.

An input end of the current bias module 6 receives an input voltage $V_{IN}$ of the linear regulator, and an output end of the current bias module 6 outputs a bias current. A first input end and a second input end of the voltage bias module 7 respectively receives the input voltage $V_{IN}$ and the bias current, and an output end of the voltage bias module 7 outputs a bias voltage. A first input end and a second input end of the flip voltage follower 8 respectively receives the input voltage $V_{IN}$ and the bias voltage, and an output end of the flip voltage follower 8 outputs an output voltage $V_O$ of the linear regulator.

Specifically, the current bias module 6 generates the bias current and outputs the bias current to the voltage bias module 7, and the voltage bias module 7 generates the bias voltage. The flip voltage follower 8 is configured to follow and compensate the output voltage $V_O$ of the linear regulator, so that the output voltage $V_O$ of the linear regulator is relatively stable. In addition, the voltage bias module 7 has the positive temperature characteristics and can mutually compensate with the flip voltage follower 8, thus to offset negative temperature characteristics of the flip voltage follower 8, so that the output voltage $V_O$ of the linear regulator may have good temperature characteristics.

In this embodiment, the current bias module 6 includes a bias current generation circuit and an auxiliary output circuit. An input end of the bias current generation circuit is connected to the input voltage $V_{IN}$ of the linear regulator; and an output end of the bias current generation circuit is connected to an input end of the auxiliary output circuit. An output end of the auxiliary output circuit is connected to the input end of the voltage bias module 7. The input end of the bias current generation circuit and the output end of the auxiliary output circuit respectively form the input end and the output end of the current bias module. A required bias current (generally, the required bias current is a nanoampere-level bias current) can be generated by using the bias current generation circuit, and the bias current of the bias current generation circuit is output to the voltage bias module by using the auxiliary output circuit.

The auxiliary output circuit includes a current mirror circuit and a field effect transistor. An input end of the current mirror circuit is connected to the output end of the bias current generation circuit, and an output end of the current mirror circuit is connected to a drain of the field effect transistor. A source and a gate of the field effect transistor are respectively connected to the input end and the output end of the current bias module. The bias current in the bias current generation circuit is copied to the drain of the field effect transistor by using the current mirror circuit, so that the field effect transistor inputs the bias current to the voltage bias module. In addition, by using the auxiliary output circuit with the current mirror circuit, there is a relative flexibility in selecting a model of the bias current generation circuit.

A working principle of the linear regulator may be described below by reference to a circuit shown in FIG. 3.

The current bias module 6 includes a bias current generation circuit and an auxiliary output circuit. The bias current generation circuit may be a nanoampere-level bias current generation circuit shown in FIG. 3. The auxiliary output circuit includes a current mirror circuit and a field effect transistor $M_2$. The current mirror circuit may include field effect transistors $M_1$ and $M_3$, a drain of the field effect transistor $M_1$ is used as the input end of the current mirror circuit, and a drain of the field effect transistor $M_3$ is used as the output end of the current mirror circuit. FIG. 4 refers to an embodiment of a specific circuit of the nanoampere-level bias current generation circuit. As shown in FIG. 4, sources of field effect transistors $M_8$, $M_{11}$, $M_{13}$, and $M_{15}$ are used as input ends of the nanoampere-level bias current generation circuit, a drain of the field effect transistor $M_{15}$ is used as an output end of the nanoampere-level bias current generation circuit.

N, J, and K in FIG. 4 represent mirror ratios of current mirror circuits. N is a mirror ratio of a current mirror circuit including transistors $M_{11}$ and $M_8$. J is a mirror ratio of a current mirror circuit including transistors $M_{14}$ and $M_{12}$. K is a mirror ratio of a current mirror circuit including transistors $M_{11}$ and $M_{13}$. $M_9$ and $M_{10}$ construct a self-cascode transistor (SCM) circuit.

Transistors $M_8$ to $M_{14}$ are main circuits of the nanoampere-level bias current generation circuit, and $M_{15}$ is a bias current output end of the nanoampere-level bias current generation circuit.

Because the current mirror circuit including the $M_{14}$ and $M_{12}$ works in the sub-threshold region, and the mirror ratio is greater than 1 (J>1), thus gate-source voltages $V_{GS}$ of $M_{12}$ and $M_{14}$ are different, and $V_{GS14}>V_{GS12}$. A source of $M_{12}$ generates a voltage, and the voltage is a difference between $V_{GS14}$ and $V_{GS12}$.

For the SCM circuit with $M_9$ and $M_{10}$, $M_{10}$ works in a linear region, and may be equivalent to a resistor in electrical characteristics. In addition, because the drain of $M_{10}$ is biased by a source voltage of $M_{12}$, a generated output current is equal to a ratio of the source voltage of $M_{12}$ to an equivalent resistor of $M_{10}$.

Because a difference between $V_{GS14}$ and $V_{GS12}$ is relatively small and is only dozens of millivolts, and the equivalent resistor of $M_{10}$ is a transistor resistor, in an actual operation, $M_{10}$ may be designed into an inverted transistor and a very large equivalent resistance can be obtained accordingly, so as to obtain output of the nanoampere-level bias current.

In conclusion, the nanoampere-level bias current generation circuit mentioned in this embodiment has features of a small output bias current, low static power consumption, and a small chip occupation area.

The input end of the nanoampere-level bias current generation circuit or the source of the field effect transistor $M_2$ is used as the input end of the current bias module 6 and receive the input voltage $V_{IN}$ of the linear regulator. The gate of the field effect transistor $M_2$ is used as the output end of the current bias module 6 and is connected to the input end of the voltage bias module 7. The output end of the nanoampere-level bias current generation circuit is connected to the drain of the field effect transistor $M_1$. The gate of the field effect transistor $M_1$ is connected to the drain of the transistor $M_1$, and is also connected to the gate of the field effect transistor $M_3$. The drain of the field effect transistor $M_3$ is connected to the drain of the field effect transistor $M_2$. The source of the field effect transistor $M_1$ and the source of the field effect transistor $M_3$ are both grounded.

The voltage bias module 7 with positive temperature characteristics can be a series self-cascode MOSFET (SSCM) circuit, and a number of stages of the SSCM circuit can be three. The SSCM circuit may include field effect transistors $M_{B1}$ to $M_{B4}$, $M_{U1}$ to $M_{U3}$, and $M_{D1}$ to $M_{D3}$ shown in FIG. 3. In this embodiment, the number of stages of the SSCM circuit is not limited, and may be selected according to various requirements for an amount of compensation and for the output voltages $V_O$. In addition, it should be noted that a specific structural form of the voltage bias module is not limited in this embodiment. Any structural form of the voltage bias module having the positive temperature characteristics can be applied to this embodiment.

Figure 3:
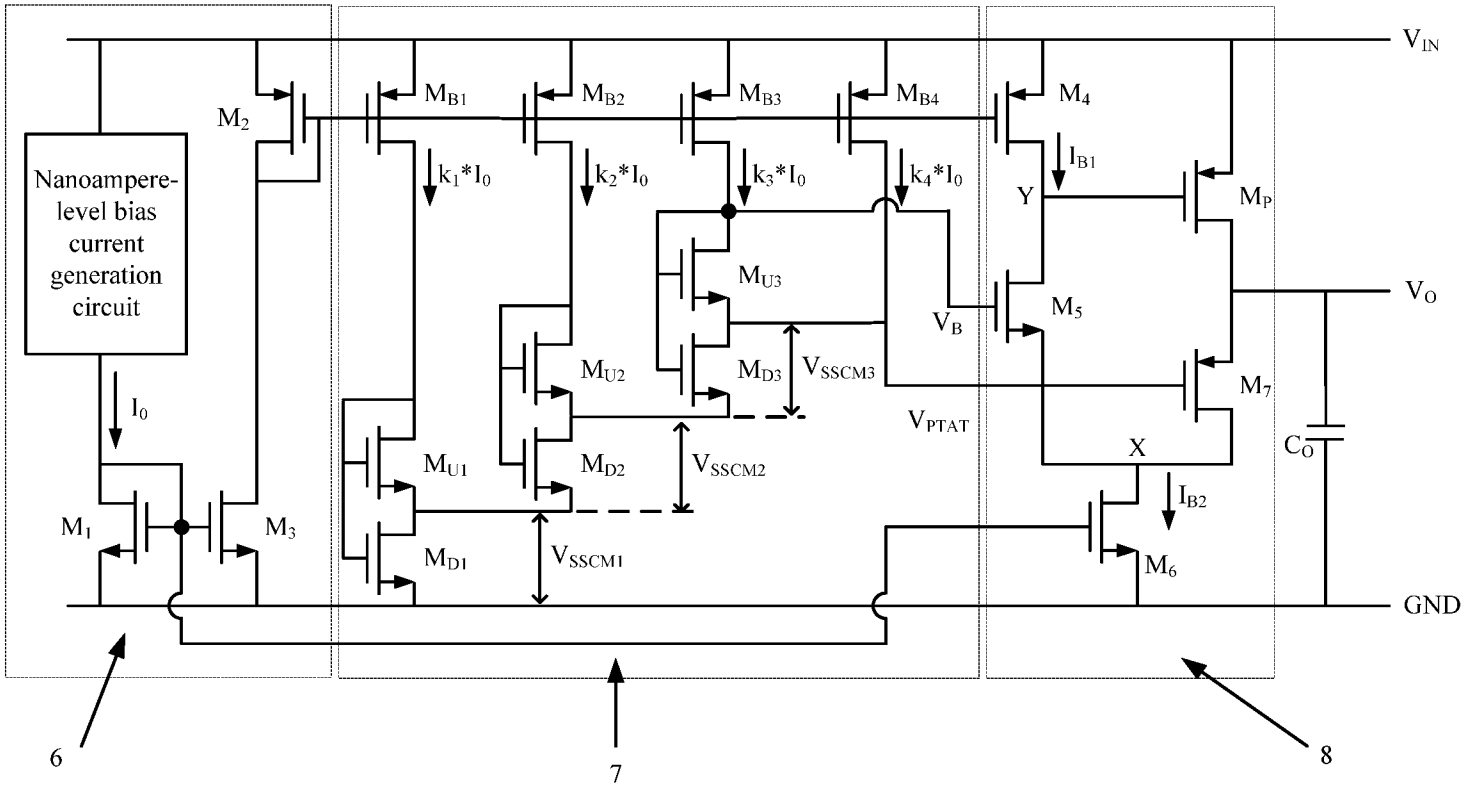
FIG. 3 is a schematic circuit diagram of a linear regulator according to the first embodiment of the present disclosure.
Figure 4:
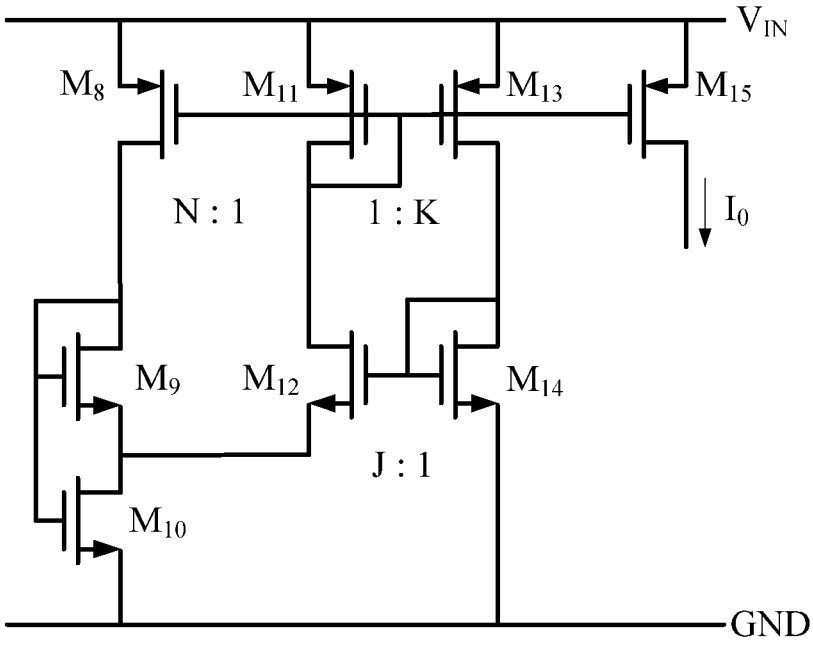
FIG. 4 is a schematic circuit diagram of a nanoampere-level bias current generation circuit according to the first embodiment of the present disclosure.

Specifically, the field effect transistors $M_{B1}$, $M_{U1}$, and $M_{D1}$ shown in FIG. 3 may form a first stage circuit of the SSCM circuit, $M_{B2}$, $M_{U2}$, and $M_{D2}$ may form a second stage circuit of the SSCM circuit, and $M_{B3}$, $M_{U3}$, and $M_{D3}$ may form a third stage circuit of the SSCM circuit. Circuits of various stages in the SSCM circuit are described in details below.

A first stage circuit of the SSCM circuit:

A source of a transistor $M_{B1}$ receives the input voltage $V_{IN}$ of the linear regulator, a gate of the transistor $M_{B1}$ is connected to the gate of the field effect transistor $M_2$, and a drain of the transistor $M_{B1}$ is connected to a drain of a transistor $M_{U1}$. A gate and the drain of the transistor $M_{U1}$ are connected to each other, and a source of the transistor $M_{U1}$ is connected to a drain of the transistor $M_{D1}$. A gate of the transistor $M_{D1}$ is connected to the gate of the transistor $M_{U1}$, and a source of the transistor $M_{U1}$ is grounded. The drain of the transistor $M_{D1}$ is connected to the source of the transistor $M_{U1}$ and is used as an output end of the first stage of the SSCM circuit, and an output voltage is $V_{SSCM1}$.

Accordingly, $V_{SSCM1}=V_{GS_MD1}-V_{GS_MU1}$, $V_{GS_MD1}$ is a gate-source voltage of the transistor $M_{D1}$, and $V_{GS_MU1}$ is a gate-source voltage of the transistor $M_{U1}$. A current amplification coefficient of $M_{B1}$ is $k_1$, so that a bias current $I_0$ generated by the nanoampere-level bias current generation circuit can be amplified to $k_1*I_0$ after passing through the transistor $M_{B1}$.

A second stage circuit of the SSCM circuit:

A source of a transistor $M_{B2}$ receives the input voltage $V_{IN}$ of the linear regulator, a gate of the transistor $M_{B2}$ is connected to the gate of the field effect transistor $M_2$, and a drain of the transistor $M_{U2}$ is connected to a drain of the transistor $M_{U2}$. A gate and the drain of the transistor $M_{U2}$ are connected to each other, and a source of the transistor $M_{U2}$ is connected to a drain of the transistor $M_{D2}$. A gate of the transistor $M_{D2}$ is connected to the gate of the transistor $M_{U2}$, and a source of the transistor is grounded. The drain of the transistor $M_{D2}$ is connected to the source of the transistor $M_{U2}$ and is used as an output end of the second stage of the SSCM circuit, and an output voltage is $V_{SSCM2}$.

Accordingly, $V_{SSCM2}=V_{GS_MD2}-V_{GS_MU2}$, $V_{GS_MD2}$ is a gate-source voltage of the transistor $M_{D2}$, and $V_{GS_MU2}$ is a gate-source voltage of the transistor $M_{U2}$. A current amplification coefficient of the transistor $M_{U2}$ is $k_2$, so that a bias current $I_0$ generated by the nanoampere-level bias current generation circuit may be amplified to $k_2*I_0$ after passing through the transistor $M_{B2}$.

A third stage circuit of the SSCM circuit:

A source of a transistor $M_{B3}$ receives the input voltage $V_{IN}$ of the linear regulator, a gate of the transistor $M_{B3}$ is connected to the gate of the field effect transistor $M_2$, and a drain of the transistor $M_{B3}$ is connected to a drain of the transistor $M_{U3}$. A gate and the drain of the transistor $M_{U3}$ are connected to each other, and a source of the transistor $M_{U3}$ is connected to a drain of the transistor $M_{D3}$. A gate of the transistor $M_{D3}$ is connected to the gate of the transistor $M_{U3}$, and a source of the transistor is grounded. The drain of the transistor $M_{D3}$ is connected to the source of the transistor $M_{U3}$ and is used as an output end of the third stage of the SSCM circuit, and an output voltage is $V_{SSCM3}$.

Accordingly, $V_{SSCM3}=V_{GS_MD3}-V_{GS_MU3}$, $V_{GS_MD3}$ is a gate-source voltage of the transistor $M_{D3}$, and $V_{GS_MU3}$ is a gate-source voltage of the transistor $M_{U3}$. A current amplification coefficient of $M_{B3}$ is $k_3$, so that a bias current $I_0$ generated by the nanoampere-level bias current generation circuit may be amplified to $k_3*I_0$ after passing through the transistor $M_{B3}$.

The flip voltage follower 8 may include a folded cascode amplifier and a power transistor MP. The folded cascode amplifier may include field effect transistors M4 to M7. A source of the field effect transistor M4 is a first input end of the folded cascode amplifier and forms the first input end of the flip voltage follower 8 together with a source of the power transistor MP. A gate of the field effect transistor M5 is a second input end of the folded cascode amplifier and forms the second input end of the flip voltage follower 8. A drain of the field effect transistor M4 is a first output end of the folded cascode amplifier and is connected to a gate of the power transistor MP. A source of the field effect transistor M7 is a second input end of the folded cascode amplifier, forms the output end of the flip voltage follower 8, and is connected to a drain of the power transistor MP.

Specifically, the nanoampere-level bias current generation circuit generates the bias current $I_0$. $I_0$ is output to the SSCM circuit after being converted by the current mirror circuit. The SSCM circuit output voltages $V_B$ and $V_{PTAT}$ respectively acting on the gate of the field effect transistor $M_5$ and the gate of the field effect transistor $M_7$. When the input voltage $V_{IN}$ of the linear regulator powers up and a circuit stably works, the output voltage of the linear regulator is $V_O=V_{PTAT}+V_{GS7}$. $V_{GS7}=V_{TH}+V_{OVM7}$, $V_{TH}$ is a threshold voltage of the field effect transistor $M_7$, $V_{OVM7}$ is an overdrive voltage of the field effect transistor $M_7$, and when the field effect transistor $M_7$ works in a sub-threshold region, $V_{OVM7}$ may be omitted.

The source of the field effect transistor $M_7$ samples the output voltage $V_O$ of the linear regulator, then the folded cascode amplifier including the field effect transistors $M_4$ to $M_7$ performs an error amplification, and a result of the error amplification is output at a node Y and acts on the gate of the power transistor $M_P$. The field effect transistor $M_4$ and the field effect transistor $M_6$ provide bias currents $I_{B1}$ and $I_{B2}$ to the folded cascode amplifier respectively, and $I_{B2}>I_{B1}$. $V_B$ is biased at the gate of the field effect transistor $M_5$ so that a node X has a proper bias voltage, to ensure that the field effect transistor $M_6$ and the field effect transistor $M_7$ both work at a proper working voltage.

Because the input voltage $V_{IN}$ of the linear regulator remains the same, if the output voltage $V_O$ of the linear regulator increases, a voltage $V_O$-$V_{IN}$ on the folded cascode amplifier also increases. In this way, a voltage on the Y node increases, so that the power transistor $M_P$ is closed, and the output voltage $V_O$ of the linear regulator decreases. Otherwise, if the output voltage $V_O$ of the linear regulator decreases, the voltage $V_O$-$V_{IN}$ on the folded cascode amplifier decreases, and the voltage on the Y node also decreases. In this case, the power transistor $M_P$ increases a supply current, so that the output voltage $V_O$ of the linear regulator increases.

It should be noted that in this embodiment, the flip voltage follower 8 may further include an output capacitor $C_0$. The output capacitor $C_0$ is connected between the output end and a ground end of the flip voltage follower 8. Stability of the linear regulator may be enhanced by using the output capacitor $C_0$.

A principle of mutual compensation of the voltage bias module 7 and the flip voltage follower 8 can be described below.

It can be known from the above descriptions that $V_O=V_{PTAT}+V_{GS7}$. Because the flip voltage follower 8 has negative temperature characteristics, the SSCM circuit needs to be reasonably designed, so that the SSCM circuit has proper positive temperature characteristics, such that the output voltage $V_O$ of the linear regulator has good accuracy within a full temperature range. That is, $V_{PTAT}$ in the SSCM circuit needs to be made to have proper positive temperature characteristics, so that $V_{PTAT}$ can compensate negative temperature characteristics of the flip voltage follower 8.

In this embodiment, a number of stages of the SSCM circuit is three, and output of an ith stage of the SSCM circuit is $V_{SSCMi}=V_{GS_MDi}-V_{GS_MUi}$. Because the SSCM circuit works in the sub-threshold region, an output of each stage of the SSCM circuit is obtained according to a current-voltage formula of the sub-threshold region:

$$V_{SSCMi} = nV_T\ln\frac{\sum_{j=i}^{4} k_j I_0}{I_{S0}S_{MDi}} - nV_T\ln\frac{k_i I_0}{I_{S0}S_{MUi}} = nV_T\ln\frac{\sum_{j=i}^{4} k_j \times S_{MUi}}{k_i \times S_{MDi}},\ i = 1, 2, 3 \quad \text{Formula (1)}$$

where n is a sub-threshold slope coefficient, $V_T$ is a thermal voltage, $I_{S0}$ is a process-related parameter, and $S_{MDi}$ and $S_{MUi}$ respectively represent channel width-length ratios of the transistor $M_{Di}$ and the transistor $M_{Ui}$.

When formula (1) is incorporated with FIG. 3, a formula (2) can be obtained as:

$$\begin{aligned} V_{PTAT} &= V_{SSCM1} + V_{SSCM2} + V_{SSCM3} \\ &= nV_T\ln\frac{\left(\sum_{j=1}^{4} k_j\right)\times S_{MU1}}{k_1 \times S_{MD1}} + nV_T\ln\frac{\left(\sum_{j=2}^{4} k_j\right)\times S_{MU2}}{k_2 \times S_{MD2}} + nV_T\ln\frac{\left(\sum_{j=3}^{4} k_j\right)\times S_{MU3}}{k_3 \times S_{MD3}} \\ &= nV_T\ln\frac{\prod_{x=1}^{3}\left[\left(\sum_{j=x}^{4} k_j\right)\times S_{MUx}\right]}{\prod_{x=1}^{3}(k_x \times S_{MDx})} \end{aligned}$$

A known threshold voltage of the field effect transistor may be represented as the following formula (3):

$$|V_{TH}(T)|=|V_{TH}(T_0)|-\alpha_{VT}(T-T_0) \quad \text{Formula (3)}$$

T is an absolute temperature, $T_0$ is a reference absolute temperature (such as a room temperature), and $\alpha_{VT}$ is a temperature coefficient of the threshold voltage of the field effect transistor.

Assuming that the field effect transistor $M_7$ also works in the sub-threshold region, the output voltage $V_O$ may be obtained as the following formula (4) by combining formula (2) and formula (3):

$$V_O = nV_T \ln \frac{\prod_{x=1}^{3} \left[ \left( \sum_{j=x}^{4} k_j \right) \times S_{MUx} \right]}{\prod_{x=1}^{3} (k_x \times S_{MDx})} + [|V_{TH}(T_0)| - \alpha_{VT}(T - T_0)] + nV_T \ln \frac{I_{B2} - I_{B1}}{I_{S0} S_{M7}} \quad \text{formula (4)}$$

It can be seen that when the quantity of stages of the SSCM circuit is N, formula (4) can be expanded as:

$$V_O = nV_T \ln \frac{\prod_{x=1}^{N} \left[ \left( \sum_{j=x}^{N+1} k_j \right) \times S_{MUx} \right]}{\prod_{x=1}^{N} (k_x \times S_{MDx})} + [|V_{TH}(T_0)| - \alpha_{VT}(T - T_0)] + nV_T \ln \frac{I_{B2} - I_{B1}}{I_{S0} S_{M7}}, \quad N = 1, 2 \ldots \quad \text{Formula (5)}$$

When the output voltage $V_O$ is derived with respect to the temperature, the following can be obtained:

$$\frac{\partial V_O}{\partial T} = n \frac{k_b}{q} \ln \frac{\prod_{x=1}^{3} \left[ \left( \sum_{j=x}^{4} k_j \right) \times S_{MUx} \right] \times (I_{B2} - I_{B1})}{\prod_{x=1}^{3} (k_x \times S_{MDx}) \times (I_{S0} S_{M7})} - \alpha_{VT} \quad \text{formula (6)}$$

And $$\frac{\partial V_O}{\partial T} = n \frac{k_b}{q} \ln \frac{\prod_{x=1}^{N} \left[ \left( \sum_{j=x}^{N+1} k_j \right) \times S_{MUx} \right] \times (I_{B2} - I_{B1})}{\prod_{x=1}^{N} (k_x \times S_{MDx}) \times (I_{S0} S_{M7})} - \alpha_{VT}, \quad N = 1, 2 \ldots \quad \text{formula (7)}$$

where $k_b$ is a Boltzmann constant, and q is a potential-charge constant.

It can be known from formula (6) and formula (7) that when the quantity of stages of SSCM, a current amplification coefficient $k_i$ (i=1, 2, . . . , N, N+1), sizes of $M_{Ui}$ and $M_{Di}$(i=1, 2, . . . , N), and a size of the field effect transistor $M_7$ are properly designed so that $$\frac{\partial V_O}{\partial T} = 0$$

can be achieved, thus the output voltage $V_O$ can have a zero temperature characteristic.

It can be seen that in this embodiment, the flip voltage follower 8 is provided to follow and compensate the output voltage of the linear regulator, so that the output voltage of the linear regulator is relatively stable. In addition, the voltage bias module 7 has the positive temperature characteristics and can mutually compensate with the flip voltage follower 8, to offset negative temperature characteristics of the flip voltage follower 8, so that the output voltage of the linear regulator has good temperature characteristics. In this way, the linear regulator does not require specifically setting a reference voltage module, which saves current consumption and which results a linear regulator with characteristics of relatively low static power consumption and a relatively small area on a chip.

Figure 5:
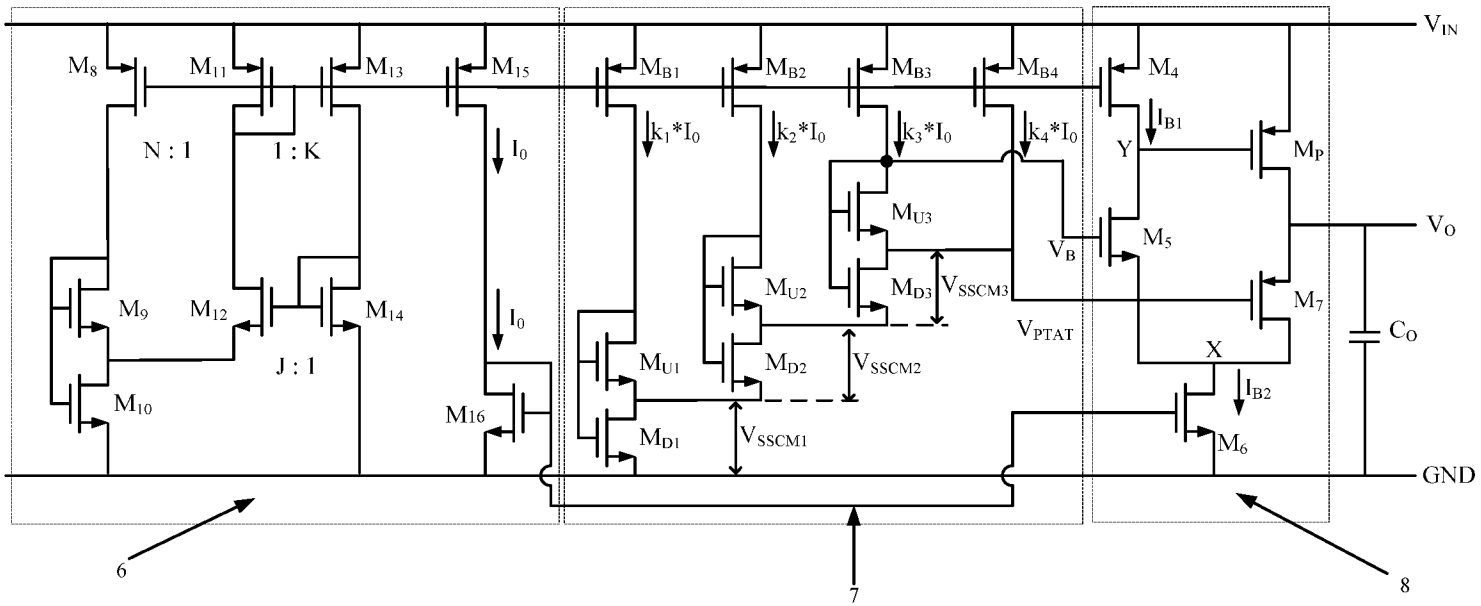
FIG. 5 is a schematic circuit diagram of a linear regulator according to a second embodiment of the present disclosure.

A second embodiment of the present disclosure relates to a linear regulator, as shown in FIG. 5. The second embodiment and the first embodiment are substantially the same and mainly differ in that: in the first embodiment of the present disclosure, the auxiliary output circuit includes a current mirror circuit and a field effect transistor. In the second embodiment of the present disclosure, the auxiliary output circuit includes only a field effect transistor $M_{16}$.

Specifically, a drain and a gate of the field effect transistor $M_{16}$ respectively form the input end and the output end of the auxiliary output circuit. The drain of the field effect transistor $M_{16}$ is connected to the input end of the nanoampere-level bias current generation circuit, and the gate is connected to the gate of the field effect transistor $M_6$ of the folded cascode amplifier. A source of $M_{16}$ is grounded, and a gate is further connected to the drain of $M_{16}$.

In this embodiment, there is no need to connect the field effect transistor $M_{16}$ to the SSCM circuit, and a function of the field effect transistor $M_{16}$ is to receive a bias current and provide the bias current to the flip voltage follower 8.

A person of ordinary skill in the art can understand that the above embodiments are specific examples of the present disclosure. However, in an actual application, various changes or modification can be made to the forms and details of these specific examples without departing from the spirit and the scope of the present disclosure.

What is claimed is:

1. A linear regulator, comprising:

a current bias module, comprising an input end and an output end, wherein the input end of the current bias module is configured to receive an input voltage of the linear regulator, and the output end of the current bias module is configured to output a bias current;

a voltage bias module having positive temperature characteristics, comprising a first input end, a second input end and an output end, wherein the first input end of the voltage bias module is configured to receive the input voltage, the second input end of the voltage bias module is configured to receive the bias current, and the output end of the voltage bias module is configured to output a bias voltage; and a flip voltage follower, configured to follow and compensate an output voltage of the linear regulator, comprising a first input end, a second input, and an output end, wherein the first input end of the flip voltage follower is configured to receive the input voltage, the second input end of the flip voltage follower is configured to receive the bias voltage, and the output end of the flip voltage follower is configured to output the output voltage of the linear regulator, wherein the voltage bias module having the positive temperature characteristics mutually compensates with the flip voltage follower to offset negative temperature characteristics of the flip voltage follower.

2. The linear regulator according to claim 1, wherein the current bias module comprises a bias current generation circuit and an auxiliary output circuit;

wherein an input end of the bias current generation circuit is connected to the input voltage of the linear regulator;

wherein an output end of the bias current generation circuit is connected to an input end of the auxiliary output circuit;

wherein an output end of the auxiliary output circuit is connected to the second input end of the voltage bias module; and wherein the input end of the bias current generation circuit and the output end of the auxiliary output circuit are configured as the input end of the current bias module and the output end of the current bias module respectively.

3. The linear regulator according to claim 2, wherein: the auxiliary output circuit comprises a current mirror circuit and a field effect transistor;

an input end of the current mirror circuit is connected to the output end of the bias current generation circuit, and an output end of the current mirror circuit is connected to a drain of the field effect transistor; and a source and a gate of the field effect transistor are connected to the input end of the current bias module and the output end of the current bias module respectively.

4. The linear regulator according to claim 2, wherein: the auxiliary output circuit comprises a field effect transistor; and a drain and a gate of the field effect transistor are configured as the input end of the auxiliary output circuit and the output end of the auxiliary output circuit respectively.

5. The linear regulator according to claim 2, wherein the bias current generation circuit comprises a nanoampere-level bias current generation circuit.

6. The linear regulator according to claim 1, wherein the voltage bias module comprises a series self-cascode MOSFET (SSCM) circuit.

7. The linear regulator according to claim 6, wherein a number of stages of the SSCM circuit is three.

8. The linear regulator according to claim 1, wherein the flip voltage follower comprises a folded cascode amplifier and a power transistor;

wherein a first input end of the folded cascode amplifier and a source of the power transistor are configured as the first input end of the flip voltage follower;

wherein a second input end of the folded cascode amplifier is configured as the second input end of the flip voltage follower;

wherein a first output end of the folded cascode amplifier is connected to a gate of the power transistor; and wherein a second output end of the folded cascode amplifier is configured as the output end of the flip voltage follower and is connected to a drain of the power transistor.

9. The linear regulator according to claim 8, wherein the power transistor comprises a field effect transistor.

10. The linear regulator according to claim 8, wherein the flip voltage follower further comprises an output capacitor; and wherein the output capacitor is connected between the output end and a ground end of the flip voltage follower.

* * * * *